United States Patent [19]

Paradis

[11] Patent Number: 4,562,603

[45] Date of Patent: Jan. 7, 1986

[54] CABLE SUPPORTED POOL STRUCTURE

[75] Inventor: Roger O. Paradis, Orleans, Canada

[73] Assignee: Nu-Tech Pools Inc., Ottawa, Canada

[21] Appl. No.: 523,845

[22] Filed: Aug. 17, 1983

[30] Foreign Application Priority Data

Aug. 18, 1982 [CA] Canada ..... 409613

[51] Int. Cl.[4] ..... E04H 3/16; E04H 3/18

[52] U.S. Cl. ..... 4/506; 4/488; 52/169.7; 220/71

[58] Field of Search ..... 4/506, 487, 488; 52/169.7, 169.8, 169.4; 220/71, 1 B

[56] References Cited

U.S. PATENT DOCUMENTS 3,534,414 10/1970 Hall ..... 4/506

3,971,075 7/1976 Heinbaugh et al. ..... 4/506 X 4,124,907 11/1978 Laven ..... 4/506 X 4,137,576 2/1979 Greene ..... 4/506 X 4,232,491 11/1980 Bumgarner, Sr. ..... 4/506 X 4,283,804 8/1981 Mahoney ..... 4/506

*Primary Examiner*—Henry K. Artis

*Attorney, Agent, or Firm*—David J. French

[57] ABSTRACT

A pool has a pool wall support structure incorporating an outer tensioned cable which is spaced outwardly from the pool wall and thrust bearing struts between the cable and the pool wall. A walkway deck or other load may be mounted over and supported by such struts. Adjustment of the tension in the cable may be monitored by reference to corner plates mounted on the pool walls and having slotted holes.

15 Claims, 8 Drawing Figures

FIG. 7
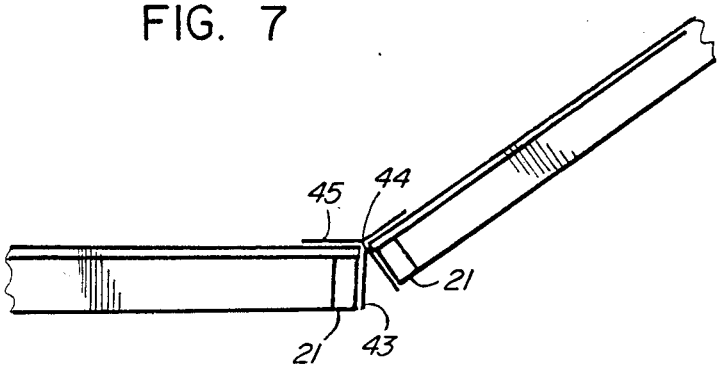
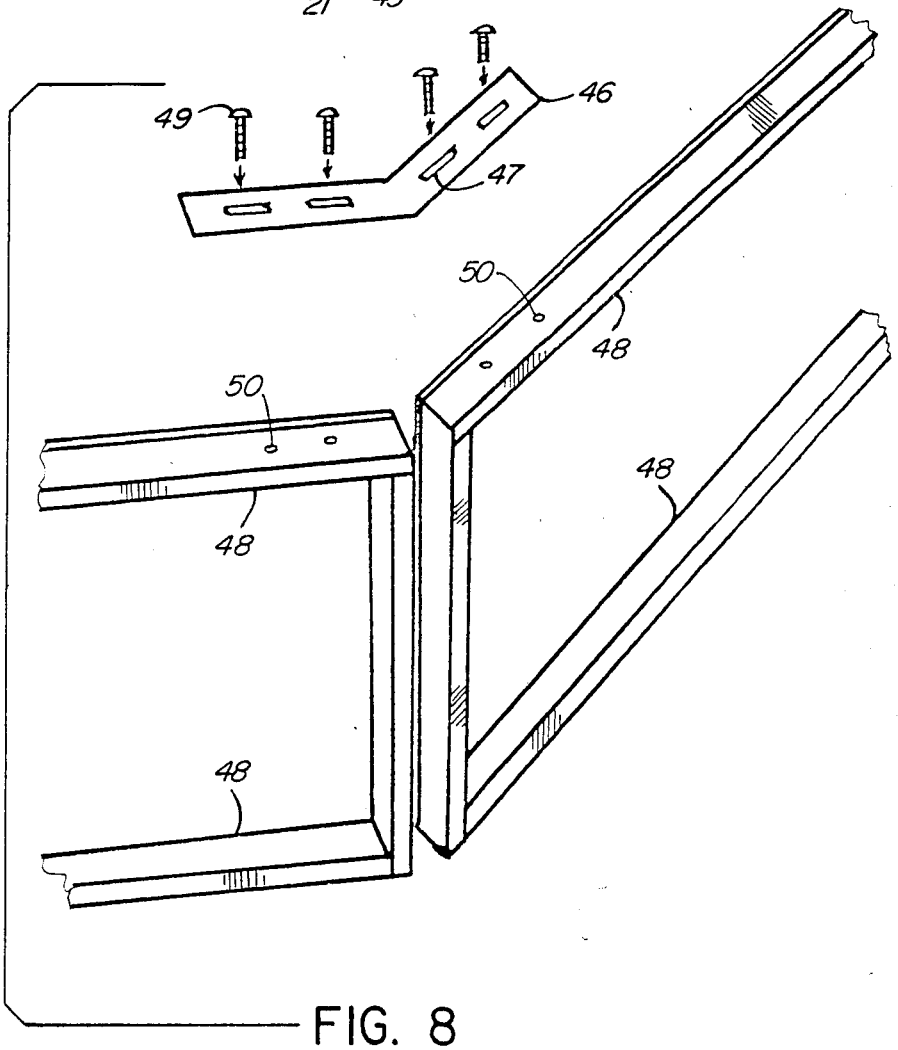
FIG. 8

CABLE SUPPORTED POOL STRUCTURE

FIELD OF THE INVENTION

This invention relates to an improved structural support system for retaining and supporting the walls of above ground pools and pool-side decks and steps.

BACKGROUND OF THE INVENTION

In the design of pool wall structures, several problems in particular are encountered. These all arise from the fact that in endeavouring to contain a large mass of water, a substantial hydraulic pressure is developed and applied against the surrounding wall. This pressure creates a spreading force which tends to stretch the pool wall and requires a pool wall support structure that provides a counteracting force to contain the water in the pool. Where the wall is composed of segmented portions, the force of the water tends to separate the pool wall segments from each other at their corners and cause corner spreading. Where the pool wall is not circular this pressure also differentially acts on pool wall segments with the tendency to reshape the walls into a circle. In cases where the pool wall segments are formed of flat panels supported at their ends by being joined to the corner of the next adjacent panel, the hydraulic pressure tends to cause bulging in the centre of the panel.

An additional problem encountered in constructing above ground pools having a pool-side walkway, deck or steps, is the expense and complication of supporting these structures.

PRIOR ART TO THE INVENTION

Techniques applied in the past to support the walls of non-circular above ground pools against bulging, and/or corner spreading and to support poolside decks and walkways have included:

(1) use of anchoring buttresses which are set in pads or footings capable of resisting the outward force transmitted to them through the buttresses and capable of supporting pool-side decks and walkways by posts placed thereon;

(2) attaching transverse tension bearing straps running underneath the pool liner and crossing from one side of the pool to the other side so as to counter-balance the corresponding forces developed on each side;

(3) use of horizontally deployed trusses, beams or girders attached to the pool walls to stiffen them against sideways deflection or bulging and sometimes to carry pool-side decks and walkways;

(4) use of heavy, ridged corner connecting structures to maintain angular relationships and transmit tension within the pool wall between adjacent wall segments.

Metal hoops and encircling cables have been used to resist the spreading and stretching of pool walls in configurations wherein the pool is of circular shape. This arrangement is equivalent to the hooped barrel in which a circular array of staves is confined by a circular hoop fitted around the sides of the barrel. Such hoops and cables have, however, generally been located directly adjacent to the circular pool wall that they contain. No case is known of a pool wall support structure which takes full advantage of a totally encircling cable which is stood-off from the pool walls by thrust-bearing struts. Nor has a cable been used to support pool-side decks and walkways or to provide support for walk-in steps which form a segment of the pool wall.

All of the above listed systems involve deficiencies. The installation of footings can be expensive. In winter conditions, frost may heave these footings, causing twisting between the structure associated with the walkway, deck or steps, and the pool wall to which they are attached. The use of under-pool straps limits the extent to which the pool may be deepened by excavating between the pool walls. Extensive use of girders, beams and trusses can increase cost, as can the use of heavy ridged corner connecting structures.

Where riged corner couplings are used to connect pool wall panel segments in the vicinity of the panel ends, stress must be transmitted from the coupling to the panels. As a consequence, the ends of panels so connected must be sufficiently reinforced to absorb this stress. This may, in turn, result in pool corner junctions which are particularly riged and unable to shift and flex in response to forces developed by sloshing of water in the pool or by heaving of the ground due to frost in the winter.

In cases where a deck or walkway hangs outwardly from a pool wall over diagonal struts which extend to the base of the pool wall, a considerable tension is applied to the upper rail which may cause deformation of the pool wall or require excessively heavy reinforcement to carry the load.

It has been proposed in the U.S. Pat. No. 3,564,623 issued to J. I. Shaeffer in 1971 to form a pool wall support structure using an outer frame assembled from a series of triangularly braced trusses. Each truss as described incorporates struts which extend outwardly from the plane of the inner wall of the frame segment associated with the truss. The struts are disposed along the truss in a series of "X" configurations and are coupled to a tensioned cable at the juncture of each "X" that is formed.

This construction produces a trussed frame segment that may then be assembled by joining a series of such segments at their ends by means of angle iron to form the frame for containing the pool wall. The tensioned cable within each individual truss assembly is held at its two ends by sleeves tightened by nuts with washers. Further, the cable in each truss assembly is held in a straight line running for virtually the entire length of the truss. The cable does not encircle the pool.

According to this prior patent, within the frame, a crib-type inner framework may be provided to transfer hydraulic pressure from any desired shape of pool to the outer truss wall frame. No distinction is made as to the orientation of pools of non-circular shape with respect to the outer frame and the cable segments contained therein. Nor is any distinction made as to which sides of a non-circular pool should preferentially face the center or ends of each truss assembly. No provision is made for supporting a load above the cable or the "X" brace struts.

SUMMARY OF THE INVENTION

Accordingly, it is one of the objects of this invention to effect a pool wall support structure in which;

(1) the spreading force of water is constrained;

(2) the tendency of flat pool wall segments to bulge is resisted;

(3) the angular relationship of adjacent wall segments in a non-circular pool configuration is maintained;

(4) support is provided for a walkway, steps or decking, mounted along the outside border of a pool wall; and, (5) means is provided to serve as an indicator of the proper adjustment of the pool support structure.

According to this invention, in its broadest scope, a freestanding pool wall support structure is provided with a tensioned cable which is fixed in association with at least a portion of the pool wall and which is stood-off from the pool wall portion by thrust-bearing struts. In every instance where the cable is connected to a thrust-bearing strut, the cable changes direction.

By a further feature of the invention, in the case of pool walls which are circular or of the shape of a regular polygon, the cable is disposed in a virtually circular shape in the form of a polygon (of not necessarily the same number of sides as the pool).

In a further feature of the invention, in the case of non-circular pool having only positive curvature, the cable is displaced further from pool wall sections having a lesser degree of curvature, than from wall sections of greater curvature. In the case of a pool of oval shape, or generally oval polygonal shape, the cable is placed to form a more nearly circular configuration than the pool it surrounds.

By a further feature of this invention, a portion of the associated tensioned cable is stood-off from the pool walls by a pair of angled upper and lower thrust-bearing struts. The lower strut terminates at the base of the pool wall and is angled upwardly proceeding away from the pool wall and towards the junction with the other strut. The upper strut extends upwardly back towards the pool wall from this junction, contacting the pool wall above the base of the pool wall. The tensioned cable is coupled to the struts, or extensions thereof, at a point outwardly displaced from the pool wall.

By a further feature of the invention a pool-side deck, walkway, or step assembly is mounted outwardly from the pool wall and is supported on the combined strut and cable formation.

By a further feature of this invention, a pool, which is either circular or non-circular, is surrounded by a structure which confines the water within the pool. Coupled to a section of this structure, or attached to an independent encircling cable, is a further tensioned cable segment which is stood-off from the pool wall by at least two pairs of struts of the form described above. A deck, walkway or step assembly is then mounted between the two pairs of struts, supported thereon with one end thereof terminating at the pool wall and the other end extending outwardly therefrom and supported on the strut and cable formation.

DESCRIPTION OF THE PREFERRED EMBODIMENT

Figure 1:
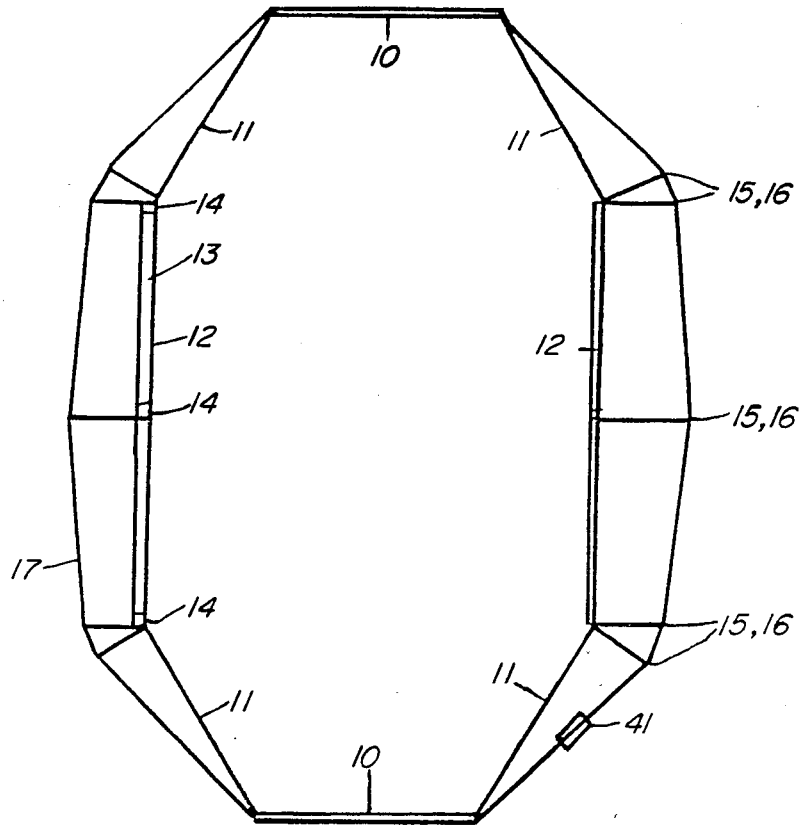

An octagonal oval-type pool wall construction will now be described as being exemplary of the invention and incorporating the preferred embodiment as contemplated by the inventor.

Figure 2:
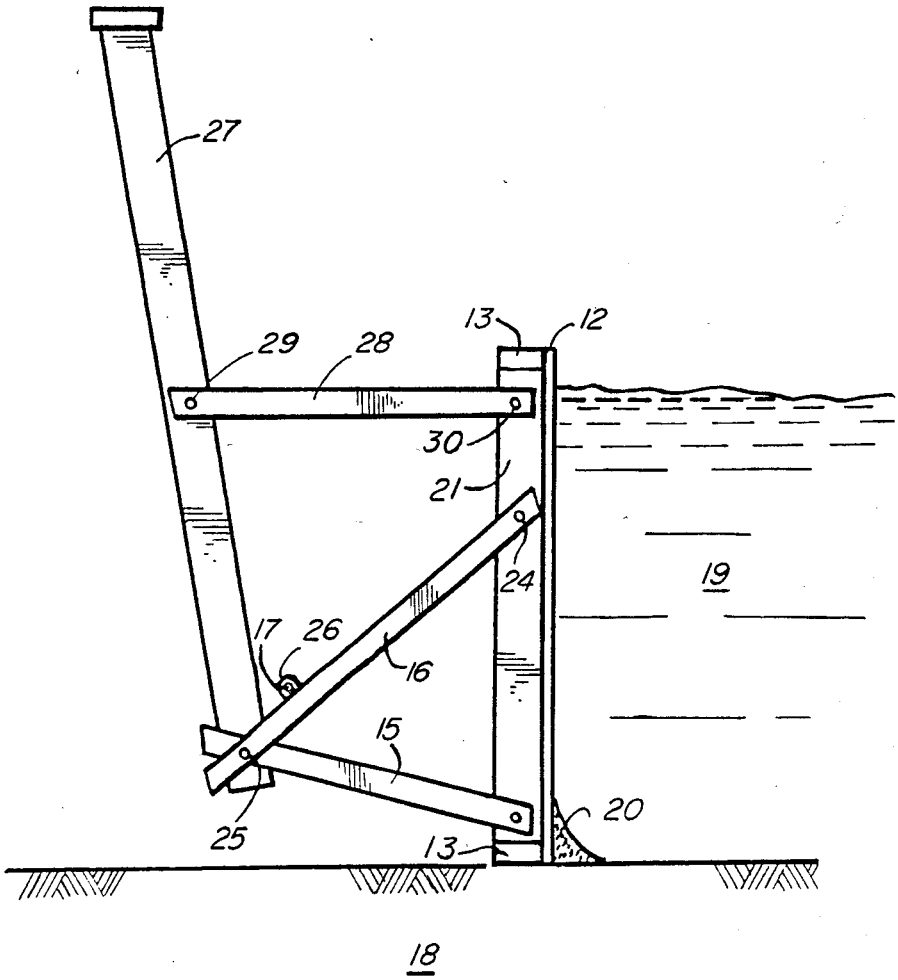
Figure 4:
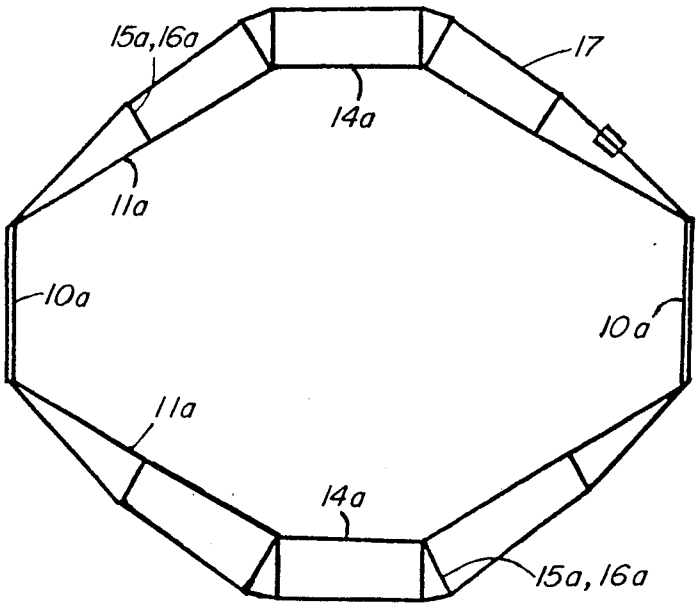
Figure 3:
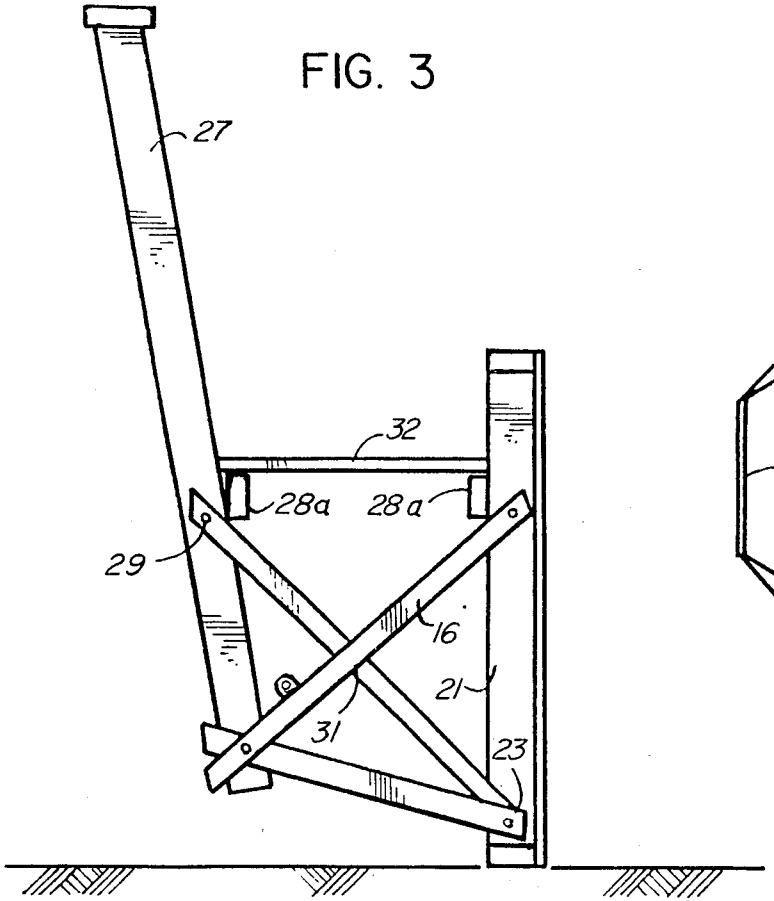
Figure 5:
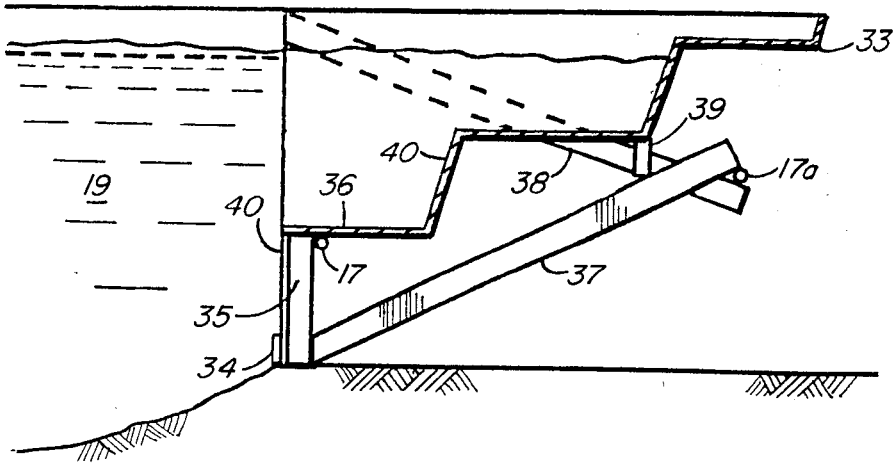
Figure 6:
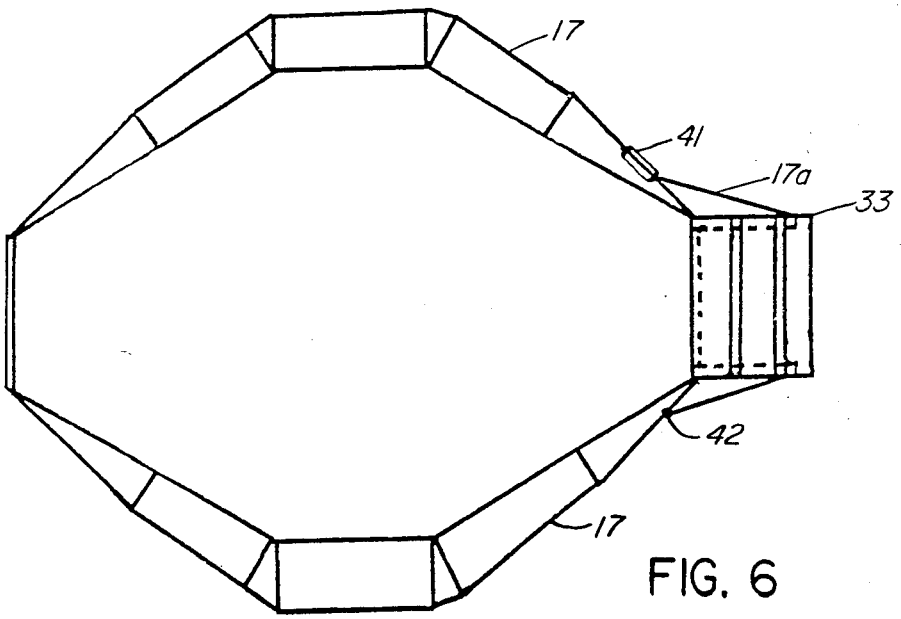

In the drawings, the following figures are provided:

FIG. 1—a plan view of the pool walls, with struts and cable in position,

FIG. 2—a sectional view through the pool wall showing the position fo the struts and cable with a walkway mounted above;

FIG. 3—an alternate plan view or variation on FIG. 2;

FIG. 4—an alternate plan view variation on FIG. 1;

FIG. 5—a sectional view of struts and cable supporting a step assembly mounted on a pool end;

FIG. 6—a plan view of FIG. 5;

FIG. 7—a plan view of a corner with a corner connecting element;

FIG. 8—an exploded perspective view of a corner formed by two panels incorporating a a stress-indicating connecting element.

In FIG. 1, an eight-sided pool wall is depicted having end walls (10) and corner walls (11) constructed of standard size 4 foot by 4 foot plywood or press board panels. Although plywood walls are shown throughout, these panels may also be made of sheet steel or of reinforced fiberglass plastic construction. Side walls (12) are constructed of similar materials in 4 foot by 8 foot panels. These plywood panels are horizontally stiffened along their upper and lower edges with 2×4 inch wood framing (13) or by steel "U" channels of equivalent dimensions which serve as rails. The panels also have for support a series of vertical braces (14) of similar materials to the rails located at the ends of each panel and on two foot centres there between.

From the lower edge or base and from a point directly thereabove on each panel at their respective ends, as shown in FIG. 2, extend two struts (15) and (16) in pairs meeting to form a "V". These struts may be of either 2×4 inch wood or steel "U" channels. Additional struts are similarly mounted at the central vertical braces on the 4 foot by 8 foot panels.

Surrounding the pool and coupled to the struts is the tensioned cable (17) shown in FIG. 1. Tension is developed in the cable by means of the turnbuckle (41). The cable appropriate for this size of pool when filled to a depth of 48 inches is of ½ inch or ⅝ inch diameter twisted steel wire, depending on the strength of the wire. Although referred to as a "cable" throughout this disclosure it is contemplated that this expression comprises any suitable tensioning element whether in the form of a rope, strap, chain or rod.

The cable runs in straight lengths between each consecutive pair of struts, changing direction as it passes by the ends of the struts. This change or deviation in the direction of the cable gives it the shape of a polygon. The connecting points between the cable and struts surrounding the generally oblate pool wall are further displaced from the pool wall opposite the longer side walls (14) which are less curved than the walls in the end and corner wall region. The result is that the polygon formed by the cable is more nearly circular than the pool walls it surrounds.

"Curvature", in the case of a pool wall formed from a series of straight or flat pool wall segments, is intended to refer to the curvature of a smooth curve that could be constructed so as to pass through the consecutive corner points of the pool wall segments where they are joined. "Positive curvature" is intended to mean a curve which appears as concave when viewed from within the region contained by the pool walls.

In the case of pool wall portions that have negative curvature, that is, walls that deflect inwardly (as found, for example, on a kidney-shaped pool) and are convex when viewed from within the pool wall such pool wall portions, in the absence of an external support structure, will be in a state of compression. The force developed within such wall portions will then be transmitted to adjacent wall portions which may, in turn, require additional support to absorb this force. Under these circumstances, it may be appropriate to displace the encircling cable further from such adjacent wall portions than from other wall portions having a lesser degree of curvature to a greater degree than would be appropriate if the pool wall portions were of continuous positive curvature.

In FIG. 2, a pool wall cross section is shown mounted on the ground (18) with water (19) in the pool. A liner lies against the inner face of the pool wall (20) and extends downward and across the pool bottom to the other side. The plywood panel side wall (12) is shown with a vertical brace (21) fastened thereto with screws (not shown). Horizontal rails or braces (13) are similarly attached at the base and along the upper edge of each of the plywood panel sidewalls (12), end walls (10) and corner walls (11).

The lower strut (15) is shown attached to and extending from the bottom of the vertical brace to which it is fastened by a bolt (23). The upper strut (16) is attached to the vertical brace by a bolt (24) and extends outwardly to where its other end is attached to the remaining end of the lower strut (15) by a bolt (25).

On the upper strut (16) is fastened a "U" bolt (26), bolted to the upper face of the strut. The encircling cable (17) passes through the space formed within this "U" bolt and transmits force to the struts (15,16) by pressing against the upper side of the strut (16).

The struts extending between the cable and the pool walls will be exposed to a sideways force if not mounted perpendicularly to the pool wall. A sideways force will also be created if the struts are not aligned in the plane bisecting the interior angle formed by the cable as it changes direction in passing by the strut. For security, therefore, all struts so exposed may be clamped both to the pool wall panels and to the cable in such a way as to prevent sideways twisting.

A vertical walkway and railing support (27) extends upwardly from the apex of the two struts (15,16) optionally joined thereto by the same bolt (25) or by other fastening means. This joining may also be effected elsewhere on the struts (15,16) other than at their apex. Alternately the struts may be joined separately to the vertical support, in either case, the cable may be attached to the vertical support as an alternative to being attached to one of the struts. Deck supports (28) in the form of joists extend horizontally, attached at one end by a bolt (29) to the vertical support (27) and at the other end to the vertical brace (21) by a bolt (30).

In FIG. 3 an alternate form of structure is shown for supporting a walkway or other load. In this version the floor joist (28) is replaced or supplemented by a diagonally mounted strut (30) running from the vertical support (27) at the bolt (29) to the base of the pool wall at bolt (23). This strut crosses the upper "V" strut (16) and may optionally be joined at its intersection with a bolt (31) to reduce its unsupported length. Deck supports (**28*a*) may then be fastened between consecutive vertical supports (27) and along the pool wall panel braces (21) providing support for decking (32). If sufficiently riged struts, braces and couplings are used, the lower strut (15**) may be dispensed within this configuration.

In FIG. 4 an alternative shape of pool is shown in which the corner walls (**11*a*) are 8 feet long and the side walls (14*a*) are 4 feet long. The centers of the longer corner wall panels (11*a*), which are more susceptible to bulging, are supported by centrally placed struts (15*a* and 16*a*). Again the cable (17) is shown as encircling the pool, displaced further from the pool walls in those regions opposite the side panels (14*a*) where the pool wall has effectively less curvature than in the vicinity of the end panels (10*a***). This renders the cable more nearly circular than the pool wall which it surrounds. Again, curvature is used here in the sense as defined earlier, above, where the pool wall is formed from a series of straight panel segments.

At the more sharply curved end, the cable (17) runs adjacent to the pool wall lying against the vertical braces (21) at approximately the same height as the cable (17) is connected to the struts (15,16) elsewhere. A sliding contact may be obtained by placing a sleeve formed from a split section of plastic pipe around the vertical brace (21) and between it and the cable (17). The cable (17) may also be contained by "U" bolts or other means (not shown) to attach it to the vertical braces (21).

It is desirable that the cable be coupled to a strut, strut extensions or vertical supports at a location mounted at a higher elevation than the base of the pool wall. Where the wall alone is being supported by the cable and struts, the optimal height for the cable is one third the depth of water in the pool above the pool wall base. If the cable is either higher of lower than this optimal height, a net torque will be developed that must be absorbed by other elements of the pool wall support structure. For minor deviations from this optimal height the required counteracting forces can conveniently be developed by the ground or by the pool wall itself and by the corner coupling elements joining adjacent pool wall sections.

When the same cable is being used both to contain the pool walls and to support a free standing pool-side deck, walkway or steps, it is preferable that the cable be located above the optimal height referred to above. The weight of the deck structure above, together with any load being applied thereto, can then serve to absorb and reduce part of the net torque being developed by the cable and struts. This is preferable to having such loads enhance the net torque that exists, a condition that will occur if the cable is mounted below its optimal height.

The suspended, freestanding support structure described herein for supporting walls and a pool-side deck, walkway or steps may be applied to either a circular or non-circular pool. In either case, if the object is solely to support a deck or other load struts need pass between the cable and the pool walls only in the regions where a vertical load is to be applied to the combined cable-strut structure. Alternately, a cable dedicated to providing a free standing support structure only for the walls may be run adjacent to the pool wall for a portion of the course of encircling the pool where the curvature is greater; and only be stood off from the pool wall by struts where the wall has lesser curvature. The cable in such cases need not encircle the pool, but may be attached to the pool wall so as to substitute a portion of the pool wall as a tension carrying structure in lieu of a portion of the cable.

In FIGS. 5 and 6 an arrangement is shown by which a premoulded riged step assembly (33) is mounted in place of a panel section in a pool wall. Steps of this type can be obtained from Fox Pool Corporation of York, Pennsylvania. Where such steps are installed in place of a side wall panel in a pool wall portion of shallow curvature, such as the side wall (**14*a*) shown in FIG. 4, they may be supported in a manner similar to that described for the walkway elsewhere herein. Where it is desired to install steps in the place of an end wall in a region of greater curvature, such as the end wall (10) in FIG. 1**, or to install a walkway or deck adjacent to such an end wall, then the following structure may be constructed.

In FIG. 5 the steps (33) are mounted on a lower rail (34) that meets with and is preferably joined to the lower rail elements of adjacent pool wall segments. A pair of vertical braces (35) may optionally extend upwardly from this rail (34) at the respective ends of the lower step to provide additional support for the lower step (36) of the step assembly (33). A further horizontal brace or rail (34*a*) may then extend between the upper ends of the vertical braces (35) to absorb partially any crushing force that may be imposed through the pool walls on the steps by the tension in the cable (17).

Extending diagonally upwards from the lower rail (34) on either side of the steps are struts (37) which intersect with and are bolted to struts (38) which extend downwardly from the upper rail of the adjacent pool wall panels to which they are attached. The step assembly is then supported on these two pairs of struts of "V" shaped formation (37,38) by a transverse bar (39) passing between and mounted on the two sets of struts.

The cable (17) which encircles the pool passes under the lower step (36) adjacent to the vertical braces (35). Since it is tensioned, it provides an inward force which counter balances, at least in part, the hydrostatic pressure developed by water (19) on the other side of the risers (40) which meet the lower step (36).

This cable (17) is shown in plan view in FIG. 6 as it passes under the step assembly (33) and then on to a turn buckle (41) which is fastened in turn to the other end of the cable (17). The cable (17) coming from the step assembly (33) passes through an eye on the turn buckle and is then, as a returning cable portion (17*a*), looped back around the two pairs of struts of "V" formation (37,38) and then returned to the cable (17) to which it is clamped by a clamp (42).

This returning cable portion (17*a*) is shown in FIG. 5 as pressing against the strut pairs (37,38) at the place where they cross. It may alternately be clamped by a "U" bolt or other means along the top or bottom sides of either of the struts (37,38) at a sufficient height above the ground to provide support for the step assembly (31) when loaded by a person descending thereon into the pool.

The effect of using a single cable (17) which is looped back through a turn buckle eyelet to support the step assembly is to provide a tension in the returning cable portion (17*a*) equal to the tension in the main cable (17). An alternate arrangement permitting an independent adjustment of tension in the cable (17*a*) supporting the step assembly (39) would be to provide the supporting cable with an independent turn buckle and fasten both of its ends to the main cable (17) by clamps. A further variation would be to use an entirely independent cable which encircles the pool either adjacently to the pool walls or mounted on the pool wall support struts (15,16). Yet a further variation would be to fasten the ends of the step supporting cable (17*a*) to the pool walls so that the walls themselves carry the tension that must be absorbed. This may be done in conjunction with dispensing with the main cable (17) and relying on the attachment of the sides of the step assembly (33) to the adjacent pool wall segments for support.

In FIGS. 7 and 8 details are provided of two corner connector elements that are adapted for use with an encircling cable support structure. The first element is a plate or sheet metal strip (43) bent into a "V" cross-section and fastened by bolts (not shown) to the upright braces (21) at the ends of adjacent panels. This is shown in plan view in FIG. 7. The point of the "V" is aligned with the inside seam of the pool wall at the corner (44) formed by the panels. To protect the vinyl liner that will be placed against the pool wall from being pinched in the seam a protective strip of metal or plastic (45) may be fastened along the corner of the sheet metal to screen it from the pool interior.

An alternate equivalent construction is to incorporate the protective strip in two parts as flanges to pieces of sheet metal bent around and bolted to the respective end panel braces and of adjacent wall segments and enclosing the end of the sheeting which forms the pool wall. The two symmetrical sheet metal pieces may then be jointed by welding along the bend of the inside flanges to create the seam between the wall sections.

The second element suitable for use as a corner connector for a cable supported pool is an angular corner plate adapted to be fastened to the upper rail or brace running along the top of each wall panel, and also to the lower rail or brace fastened along the bottom of each panel and forming the base of the pool wall. This element is shown in FIG. 8.

Mounted at the ends of upper and lower rails (48) of adjoining wall panels is an angled corner plate (46) having slotted holes (47) which serve to indicate the state of stress, i.e. tension or compression, existing at the corners. Only the top plate is shown in FIG. 8. The plates (46) have two legs which are shaped and angled to fit respectively onto and lie adjacent to the surfaces of the ends of adjoining rails (48). Bolts (49) pass through holes (50) in the ends of each of the rails (48) which are aligned and pass through the slots (47) in the angled plates (46) when assembled. While two sets of slots (47) are shown, it is sufficient to have slots only in one of the arms of each plate. The bolts (49) are tightened to permit them to slide within the slots (47).

When a corner is under compression, the bolts (49) tend to slide towards each other in the slots (47). Under tension, the bolts (49) tend to slide apart, towards the opposite ends of their respective slots (47). As long as a bolt is positioned relatively towards the centre of its slot (47) and away from the limit of travel at the ends of its slot (47) this is an indication that the corner is in a relatively modest or near zero state of tension or compression.

When the pool wall structure is assembled initially the cable is lightly tensioned until all angled corner plates indicate that the corners have just entered a state of compression. As the pool is progressively filled with water, the tension in the cable is increased by adjusting the turn buckle whenever all of the angled corner plates indicate that the corners have entered a state of tension. Once the pool is filled to its desired level, the cable tension is adjusted so that all corners are in a near zero state of stress. Alternately, cable tension is adjusted so that some of the angled corner plates indicate that the associated corners are under compression; while other corner plates indicate a condition of tension.

As an alternative to having a slot in the corner plate (46) slots may be formed in the rail (48) in lieu of one of the holes (50) in the rail (48). The tension indicating effect may be observed as the bolt (49), passing through holes in the corner plate, slides within the slot in the rail.

The embodiments of the invention in which an exclusive property or privilege is claimed are defined as follows:

1. A pool wall support structure having side-walls for containing a liquid retained by a circumscribing structure comprising:

(a) outer cable means adapted to withstand a state of predetermined continuous tension mounted above the base of said side-walls;

(b) a plurality of compression sustaining spacing means disposed intermediate said side-walls and said outer cable means and coupled to said cable means at selected points; and (c) means for maintaining said outer cable means in said state of predetermined continuous tension and thereby compressing said spacing means towards said side-walls wherein said cable means changes direction at said selected points of coupling with said spacing means.

2. A pool wall support structure as defined in claim 1, wherein said spacing means are thrust bearing strut means and said cable means encircles the pool wall.

3. A pool wall support structure as defined in claim 2, wherein the angle of change of direction of the cable at the points of coupling with said thrust bearing strut means at said selected points increases with increases in pressure exerted by said liquid on the said strut means terminating at the respective selected points.

4. A pool wall support structure as defined in claim 2 wherein the strut means comprises:

(a) a lower strut member extending upwardly from a lower portion of the pool wall;

(b) an upper strut member extending downwardly from a point on the pool wall above the base thereof to a point where said upper strut intersects said lower strut;

(c) connection means between said upper and lower strut members at said point of intersection at a point removed from the pool wall.

5. A pool wall support structure as defined in claim 4 wherein the cable is coupled to one of the strut members in the region of the intersection between the upper and lower strut members.

6. A pool wall support structure as defined in claim 5 wherein the point of connection between the cable and strut means is elevated at a height above the ground which is approximately equal to one third of the height of the water in the pool.

7. A pool wall support structure as defined in claim 2 wherein the pool wall comprises segments in the form of flat wall panels, at least some of which panels are supported between their ends by said strut means.

8. A pool wall support structure as defined in claim 2 wherein said spacing means comprises a plurality of thrust bearing strut means supporting differing portions of the pool wall in which:

(a) the pool wall is non-circular;

(b) the configuration of the encircling cable is more nearly circular than the pool wall which it surrounds.

9. A pool wall support structure as defined in claim 1 in which said spacing means comprises:

(a) a lower strut member extending upwardly from a lower portion of the pool wall;

(b) an upper strut member; and a load supporting member is mounted over and connected to said cable means.

10. A pool wall support structure as defined in claim 9 in which said load supporting member is a walkway mounted adjacent to a portion of said pool wall of relatively lesser degree of curvature.

11. A pool wall support structure as defined in claim 9 in which said load supporting member comprises a set of inwall, preformed steps descending into the pool.

12. A pool wall support structure as defined in claim 1 incorporating stress-indicating corner connecting elements in a pool having wall segments composed of panels with at least an upper and lower horizontal rail attached thereto comprising:

(1) a flat plate having two angled legs each respectively mounted at and along the ends of the rails of adjacent panels;

(2) said plate having at least one slotted hole in one of said legs and connection means associated with the other leg adapted to connect the plate to the end of a rail on a panel;

(3) bolt means coupled to the remaining rail and passing through said slotted hole.

13. A pool incorporating a pool wall support structure as defined in claim 1.

14. A pool incorporating a pool wall support structure as defined in claim 6.

15. A pool incorporating a pool wall support structure as defined in claim 9.

* * * * *